United States Patent [19]

Rossell

[11] Patent Number: 4,511,771

[45] Date of Patent: Apr. 16, 1985

[54] ELECTRIC FENCE GATE SWITCH

[76] Inventor: Thomas L. Rossell, R.R. 2, Box 313-3, Clayton, Ind. 46118

[21] Appl. No.: 575,004

[22] Filed: Jan. 30, 1984

[51] Int. Cl.[3] ..... H01H 3/16

[52] U.S. Cl. ..... 200/61.73; 200/61.62; 200/61.72; 200/61.75

[58] Field of Search ..... 200/52 R, 61.62, 61.71, 200/61.72, 61.73, 61.74, 61.75

[56] References Cited

U.S. PATENT DOCUMENTS

| | | | |
|---|---|---|---|
| 1,039,142 | 9/1912 | Keenleyside | 200/61.74 |
| 2,454,348 | 10/1948 | Schilling . | |
| 2,540,562 | 2/1951 | Wood . | |
| 2,605,565 | 8/1952 | Meyer, Jr. . | |
| 2,796,485 | 6/1957 | Durkee . | |
| 3,684,248 | 8/1972 | Maes, Jr. . | |
| 4,151,382 | 4/1979 | Kaufman et al. | 200/61.71 |

*Primary Examiner*—A. D. Pellinen

*Assistant Examiner*—Susan A. Steward

*Attorney, Agent, or Firm*—Woodard, Weikart, Emhardt & Naughton

[57] ABSTRACT

An electric fence gate switch for controlling the flow of electricity across spaced electric fence wires in association with the opening and closing of an electric fence gate. The switch comprises first and second insulating members rigidly mounted to the gate post and fence post of an electric fence, a first leaf spring mounted to the first insulating member and connecting to one of the electric fence wires, and a second leaf spring mounted to the second insulating member and connecting to the other of the electric fence wires. The first and second leaf springs are in a position of aggressive contact urging each other into spring tension when the gate is in a closed position. The switch automatically closes as the gate is pivoted into a closed position without having to manually connect the first and second conducting means after the gate is moved to its closed position.

2 Claims, 4 Drawing Figures

ELECTRIC FENCE GATE SWITCH

BACKGROUND OF THE INVENTION

The present invention relates generally to an electrical switch, and more particularly, to a switch which is adapted to control the flow of electricity across spaced electric fence wires in association with the opening and closing of an electric fence gate.

Electrified fences have been in use for many years as a highly effective yet relatively inexpensive means for confining animals within long boundaries. If an existing fence is already in place, the fence can be modified so that it also presents an electrical barrier by stringing an exposed wire at a desirable height along the existing fence, with the wire mounted on insulators which are themeselves mounted to the fence at spaced intervals.

A problem, however, arises at gate locations where access by persons through the fence is desired. As the gate is opened and closed to permit ingress and egress therethrough, it is also necessary to control the flow of current through the wire so that it does not present a safety hazard to such persons. Switches for this purpose should be rugged and durable, since they must be operated in all-weather conditions. Further, such switches should be sufficiently insulated from the fence so that a person touching the gate will not receive an electrical shock. Ideally, the switch should be simple in design, so that it is easliy installed, have a minimum number of parts and also be cheaply priced.

Typically, switches for this purpose have not been totally acceptable from one view or another. Thus, the following patents disclose various types of gate switches for electrified fence gates:

| U.S. Pat. No. | Inventor | Issued |
|---|---|---|
| 2,454,348 | Schilling | Nov. 23, 1948 |
| 3,684,248 | Maes, Jr. | Aug. 15, 1972 |
| 2,540,562 | Wood | Feb. 6, 1951 |
| 2,605,565 | Meyer, Jr. | Aug. 5, 1952 |
| 2,796,485 | Durkee | June 18, 1957 |

U.S. Pat. No. 2,454,348 to Schilling discloses a latch for an electric fence gate which serves both as a gate latch and as a switch for controlling the flow of electricity in association with opening and closing the gate. This device, however, is disadvantaged because it requires a person to manually open and close the connection for the electrified wire. Thus, electrical shock hazards are present despite the fact that the handle portion is provided with means to prevent snow and water from creating a conducting path to the hand of the person operating the gate. Further, this device is not adapted for use with conventional gates having an electrified fence wire.

U.S. Pat. No. 3,684,248 to Maes, Jr. discloses a fence gate handle for an electrified fence. This device also requires the operator to manually open and close the connection for the electrified wire. Thus, in addition to presenting inherent shock hazards, the device is cumbersome when used on an electrified fence wire attached to a conventional gate since the operator must separately manually open and close both this device and a conventional latch securing the gate.

The remaining patents all disclose automatically operated switches for electrified fence gates. Each of these devices, however, requires activation or deactivation by a vehicle driving through the gate. Thus, none of these devices are designed to permit pedestrian ingress and egress.

SUMMARY OF THE INVENTION

An electric fence gate switch for controlling the flow of electricity across spaced electric fence wires in association with the opening and closing of an electric fence gate, according to one embodiment of the present invention, comprises first and second insulating members rigidly mounted to the gate post and fence post of an electric fence. There is further provided a first conducting means including a resilient spring mounted to the first insulating member, the spring connecting to one of the electric fence wires. In addition, a second conducting means mounted to the second insulating member and connecting to the other of the electric fence wires. Thus, the first and second conducting members are in a position of aggressive contact under spring tension from the spring when the gate is in a closed position and the switch automatically closes as the gate is pivotted into a closed position without having to manually connect the first and second conducting means after the gate is moved to its closed position.

It is an object of the present invention to provide an improved gate switch for an electric fence gate.

Related objects and advantages of the present invention will become more apparent by reference to the following figures and detailed description.

DECRIPTION OF THE PREFERRED EMBODIMENT

Figure 1:
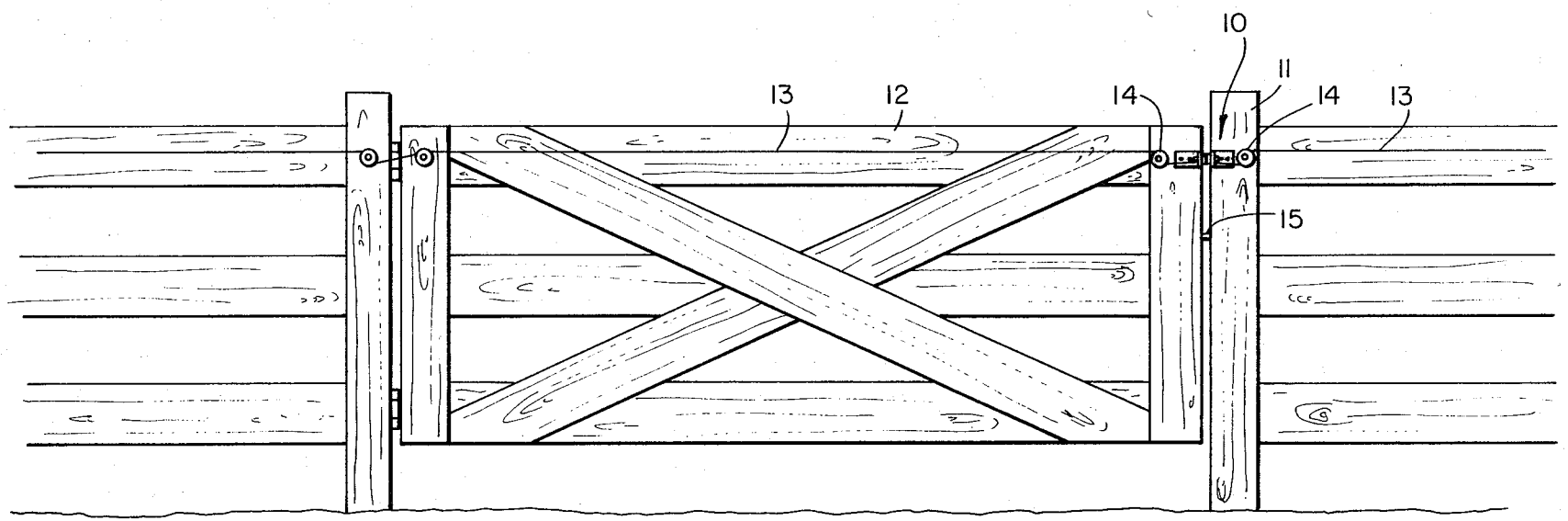
FIG. 1 is a front elevation view showing the preferred embodiment of the electric gate switch of the present invention with the fence and gate in a closed position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, there is shown generally at 10 the electric gate switch of the present invention securely mounted to fence 11 and gate 12 and operatively connected to spaced ends of an electric fence wire 13. While not shown, it is understood that wire 13 is connected to a suitable electric power source in such manner that any animal coming into contact with the fence while in contact with the ground will receive a sufficiently strong electrical shock to prevent the animal from charging the fence.

Wire 13 is strung along fence 11 and gate 12 at an appropriate height for the type or types of animals being confined and attached to insulators 14 directly mounted at spaced intervals on fence 11 and gate 12.

Figure 2:
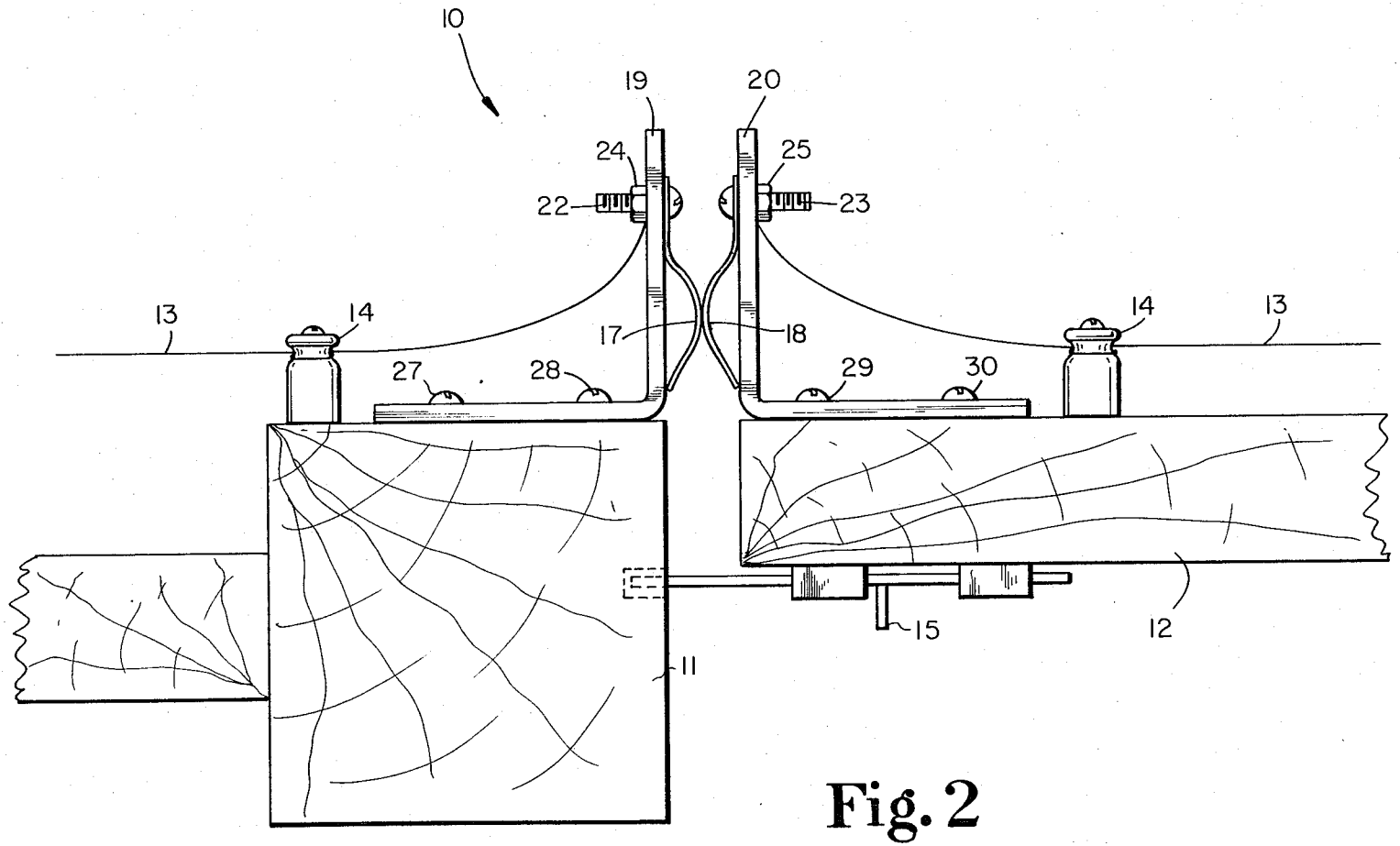
FIG. 2 is a fragmentary top elevation view of the electric gate switch shown in FIG. 1.

A latch 15 of conventional design secures gate 12 in the normally closed position depicted in FIGS. 1 and 2, gate 12 being hinged to fence 11 at the end opposite latch 15. Latch 15 is preferably mounted on the side opposite to switch 10 and at a different height in order to prevent accidental contact with wire 13 when operating latch 15.

Switch 10 includes a pair of leaf springs 17 and 18 fixedly secured to a pair of L-shaped insulating members 19 and 20 by fastening means comprising screws 22 and 23 and nuts 24 and 25, respectively. Screws 22 and 23 and nuts 24 and 25 also secure the ends of wire 13 to members 19 and 20 on the side opposite leaf springs 17 and 18, respectively. Each of the members 18 and 19 is provided with a pair of spaced apertures receiving screws 27–30, respectively, for mounting the members to the fence and gate. While not shown, it may be appreciated that the length of the legs of members 19 and 20 may be made adjustable in order to facilitate mounting switch 10 so that leaf springs are properly positioned in a manner fully described hereinafter. Also, while members 19 and 20 are formed for attachment to a rectangular shaped post, it should be obvious that they may also be made for mounting to round posts. Members 19 and 20 may be formed of any suitable non-conducting material, such as a resinous plastic, which serves to insulate switch 10 from the fence and gate so as to prevent the possibility of anyone touching the gate receiving an electrical shock from wire 13.

Figure 3:
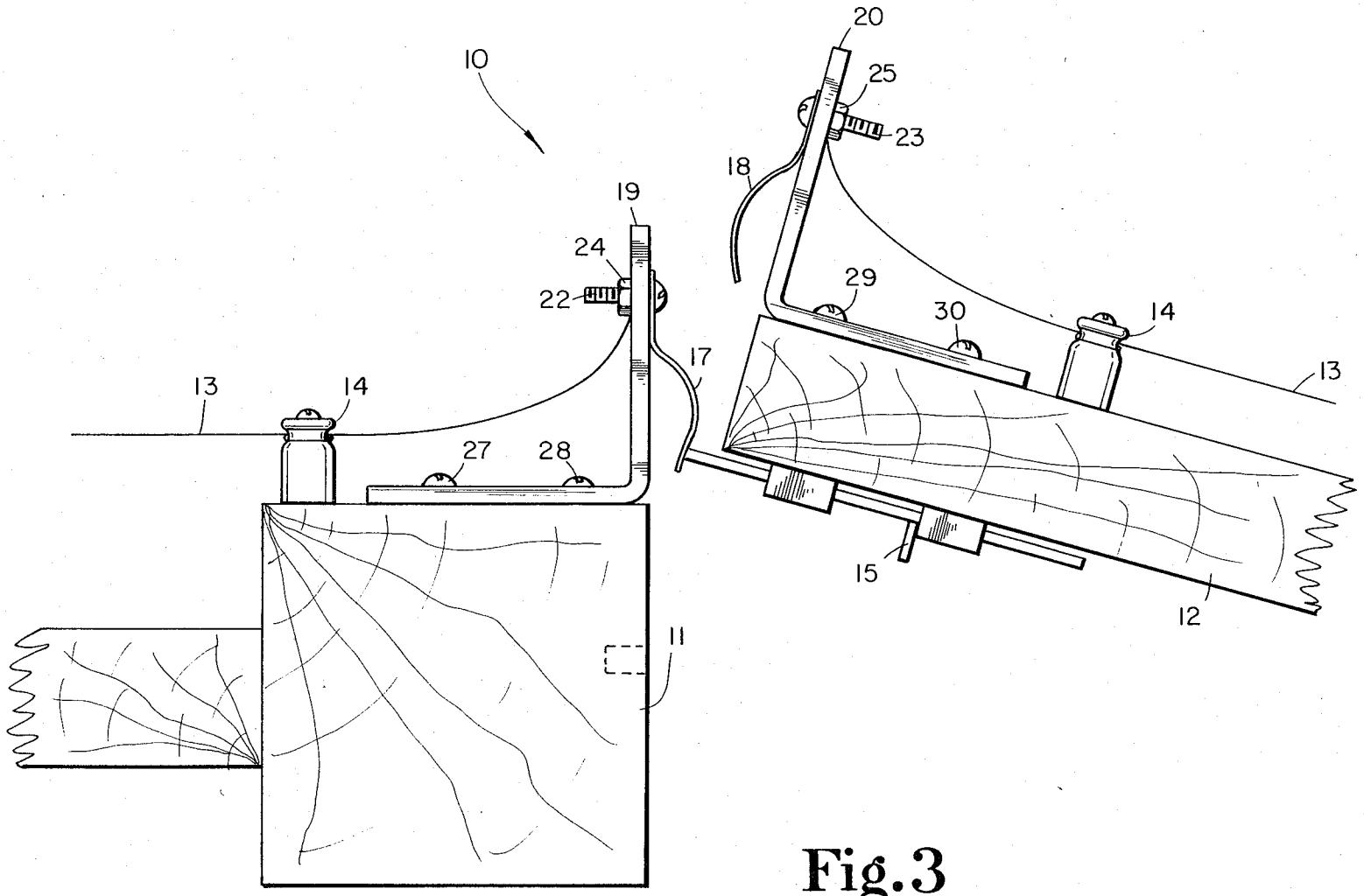
FIG. 3 is a fragmentary top elevation view showing the operation of the electric gate switch of FIG. 1 as the gate is pivotted to an open position.

Leaf springs 17 and 18 are each resiliently formed and are comprised of a relatively thin strip of suitably conducting sheet metal. When the gate is in the closed position depicted in FIG. 2, leaf springs 17 and 18 contact and mutually urge one another into a biased configuration. As shown in FIG. 3, as gate 12 is opened, leaf springs 17 and 18 separate and resiliently return to their unbiased configuration. Springs 17 and 18 are preferably formed of a metal, such as spring steel, which is both resilient and sufficiently non-corrosive to withstand long term exposure to adverse weather conditions.

Figure 4:
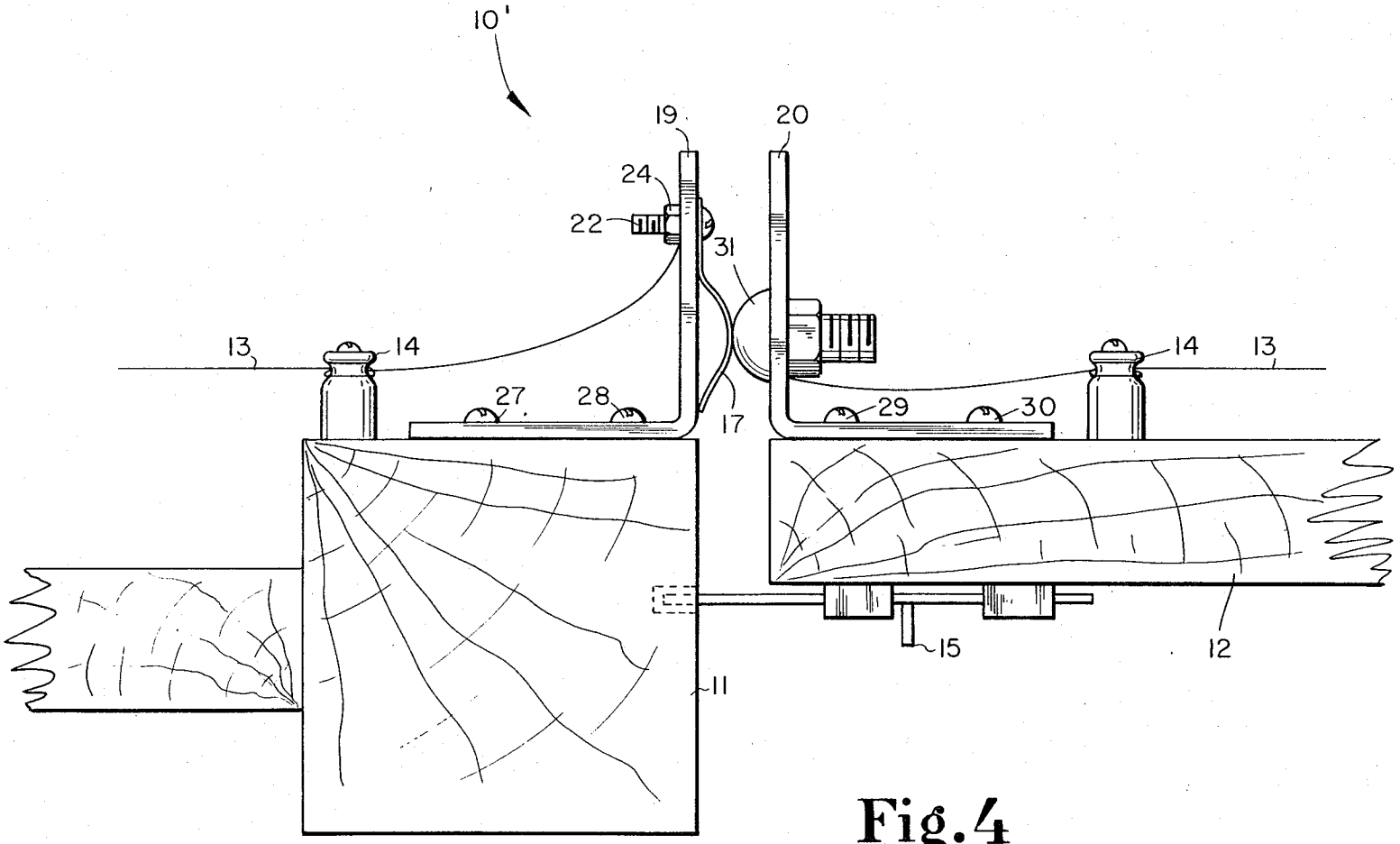
FIG. 4 is a fragmentary top elevation view showing an alternative preferred embodiment of the electric gate switch of the present invention.

Referring now to FIG. 4 an alternative preferred embodiment of switch 10 is depicted. In this embodiment, only one leaf spring is employed, the other leaf spring being replaced by a bolt 31 having a relatively large hemispherical head. Bolt 31 is made from lead or other suitably conducting material.

From the above description it shoud be obvious that the present invention has the advantage of a simple construction which makes it relatively inexpensive to manufacture, install and maintain. Should the leaf spring member or members become defective for any reason, they may be easily removed and replaced without requiring the entire switch to be replaced. Further, the gate may be opened without having to contact any part of the switch, resulting in increased safety to a person opening or closing the gate. In addition, a further convenience is provided in that it is not necessary to separately manually open and close the gate switch in conjunction with opening and closing the gate latching means.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. For example, it is contemplated that other types of spring means may be used to permit electrical contact between the spaced wires when the gate is closed. Thus, a coil spring may be substituted for one of the leaf springs and used to urge a conducting member, such as a pin slidably mounted on one of the insulating members, against the other conducting member when the gate is in a closed position.

What is claimed is:

1. An electric fence gate switch for controlling the flow of electricity across spaced electric fence wires in association with the opening and closing of an electric fence gate, comprising:

first and second insulating members adjustably mounted to the gate post and fence post of an electric fence, said first and second insulating members being horizontally spaced apart L-shaped mounting brackets having outwardly extending legs having mutually facing and opposed sides;

a first conducting means including a resilient leaf spring mounted to the facing side of the first of said L-shaped mounting brackets, a second conducting means mounted to the facing side of the second of said L-shaped mounting brackets; and a means, mounted to each of said L-shaped mounting brackets, for electrically connecting said first and second conducting means to said spaced electric fence wires with said wires mounted on said opposed sides of said L-shaped mounting brackets, said leaf spring and said second conducting means resiliently urged together under spring tension from said spring when said gate is in a closed position, whereby said switch automatically closes as said gate is pivoted into a closed position without having to manually connect said first and second conducting means after said gate is moved to its closed position.

2. The electric fence gate switch of claim 1, wherein said first and second conducting means are leaf springs.

* * * * *